United States Patent [19]

Eandi

[11] 4,193,585

[45] Mar. 18, 1980

[54] HANDRAIL ASSEMBLY FOR CURVED STAIRCASE

[76] Inventor: Roger Eandi, 4201 Bemis, Oakland, Calif. 94605

[21] Appl. No.: 850,925

[22] Filed: Nov. 14, 1977

[51] Int. Cl.[2] ..... E04H 17/14; E06C 7/18

[52] U.S. Cl. ..... 256/65; 182/106

[58] Field of Search ..... 52/182, 187; 182/106; 248/74 R, 74 A; 256/19, 21, 59, 65; 428/379; 174/74 A, 74 R

[56] References Cited

U.S. PATENT DOCUMENTS

| | | | |
|---|---|---|---|
| 2,869,829 | 1/1959 | Spangberg | 256/65 |
| 2,969,955 | 1/1961 | Newman | 256/21 |
| 3,372,909 | 3/1968 | Attaway | 256/21 X |
| 3,474,882 | 10/1969 | Ernst | 182/106 |

*Primary Examiner*—Doris L. Troutman

*Attorney, Agent, or Firm*—Warren, Chickering & Grunewald

[57] ABSTRACT

A handrail assembly for a curved staircase, which includes baluster means having support elements adapted to connect to a handrail with connectors such as screws and a handrail formed from stranded aluminum cable coated with a continuous layer of heat-sealable plastic and connected to the support elements. Methods for splicing the handrail and mounting it on the staircase are also disclosed.

13 Claims, 12 Drawing Figures

Fig. 1
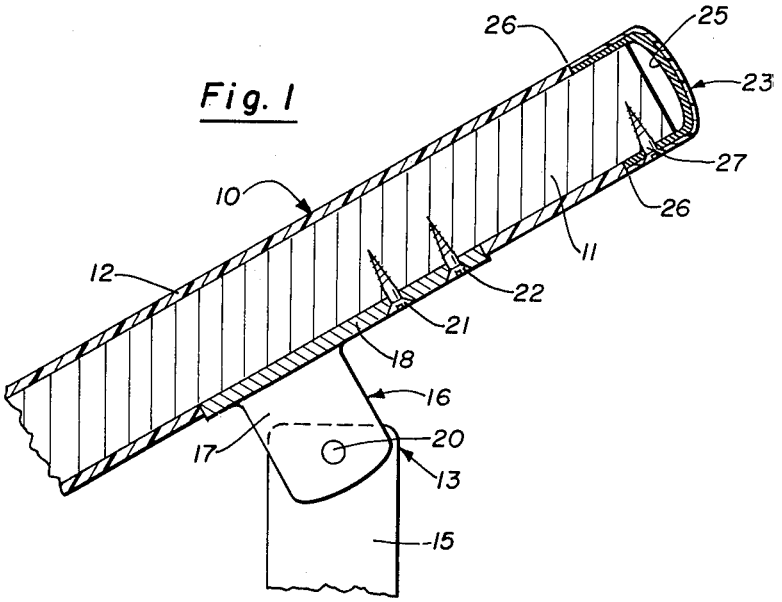
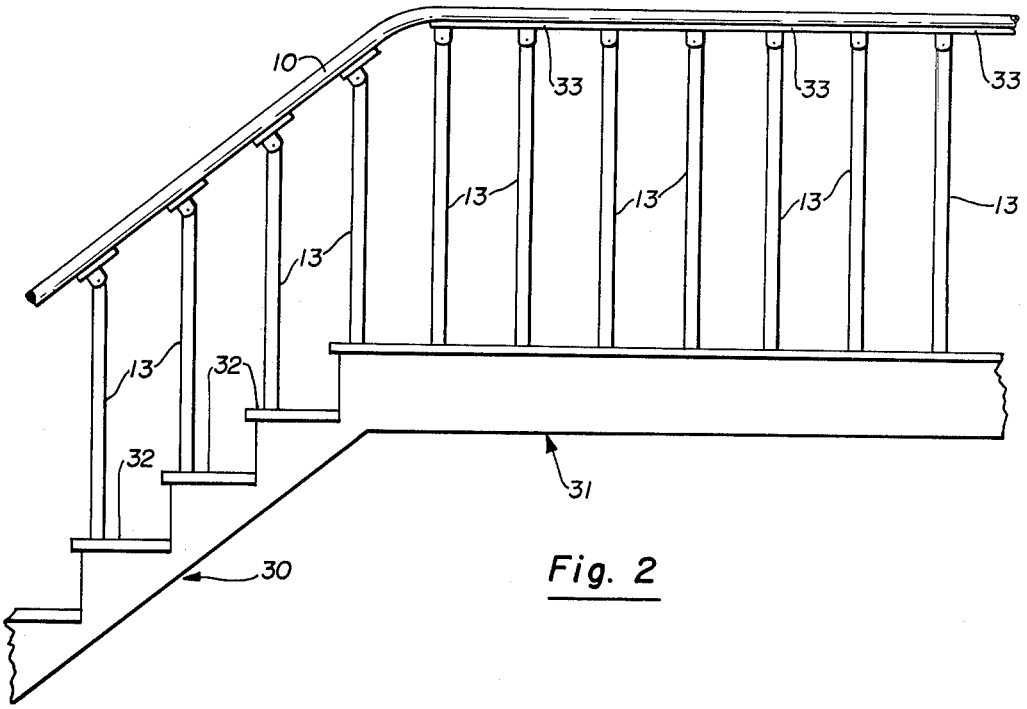
Fig. 2

47

HANDRAIL ASSEMBLY FOR CURVED STAIRCASE

BACKGROUND OF THE INVENTION

This invention deals with the subject of providing handrails for curved staircases. Curved staircases are important architecturally, both as aesthetic variations from ordinary staircases and to provide staircases to accommodate to difficult architectural situations. Typically, a spiral staircase is effective for small floor areas or where staircases are added by remodeling.

Modern architecture employs free-form staircases which, with modern developments, are easy to make and attractive. For example, U.S. Pat. No. 3,474,882 describes prefabricated modular elements capable of being assembled into staircases of substantially any form or shape. Spiral and modern free-form staircases have many advantages. They are prefabricated and therefore are relatively inexpensive. They are modular and the modules can be assembled into staircases of substantially any shape and size to fit any architectural situation. The modules may be shipped flat and broken down and assembled at the site of use rather than built there. This feature greatly reduces the cost of such a staircase. Modern modular staircases are capable of being formed in helical segments from flat parts. Curved segments, helical segments, and straight segments can be intermixed to form substantially any size or shape.

Although modern, modular curved staircases are inexpensive to make, to ship, and to assemble, the handrails for such staircases are difficult to produce, ship and assemble. Handrails desirably are continuous and such handrails must be shipped in one piece. It is axiomatic that as the staircase becomes more complicated in its curves and forms, the handrail also becomes more complicated. In many cases, handrails are even more complicated than the staircase they were made for because the handrail on the inside of a curve in a staircase must have a different length and pitch than the handrail on the outside of the curved staircase. Additionally, long helical handrails must not only accommodate to the length and pitch of the particular part of the staircase they are designed to adapt to but they themselves must be formed as helixes. For example, if a helical handrail for a spiral staircase would have a line drawn along its upper crest for its entire length and if that handrail were then disassembled from the staircase and straightened, that straight line would become a helix spiraling around the surface of the handrail.

As a result of the foregoing problems, beautiful, imaginative, unique, useful curved staircases can now be readily made inexpensively, but the handrail to fit such a staircase is expensive in design and execution and it is difficult to install.

SUMMARY OF THE INVENTION

This invention is a handrail assembly that is particularly adapted for a curved or free-form staircase, which handrail assembly corresponds in adaptability and in inexpensiveness with the staircases it is to be used with. A handrail of this assembly includes a plurality of baluster means, each having support means to support a cylindrical handrail and to accept a connector to connect the handrail to the baluster, such as a screw. Each of the baluster means also includes means to fix the baluster means at a predetermined height above the treads of the staircase. A stranded, cylindrical aluminum cable coated with a continuous, flexible, plastic material having an outside diameter of at least 0.75 inches (1.9 centimeters) is fixed by a connector to each of the support means to form a continuous, cylindrical, rigid handrail for the staircase.

In the context of this specification and the appended claims, the term "baluster" is intended to mean a support for a handrail used in connection with a staircase. The term is intended to include conventional balusters such as those that connect to the tread of a staircase as well as to means that support the handrail by being fixed to a wall or fixed to a central column supporting a spiral staircase. The term "plastic" as used in this specification includes thermoplastic materials that are in the form of fils or layers surrounding a stranded aluminum cable. The term "aluminum" is intended to include aluminum alloys.

DETAILED DESCRIPTION OF THE INVENTION

This invention may be better described with reference to the accompany drawings.

FIG. 1 is a partial, sectional, elevation view of a handrail embodying this invention and illustrating its connection to the upper portion of a baluster and an end cap for the handrail.

FIG. 2 is a partial elevation view of a staircase and landing illustrating an embodiment of this invention.

Figure 3:
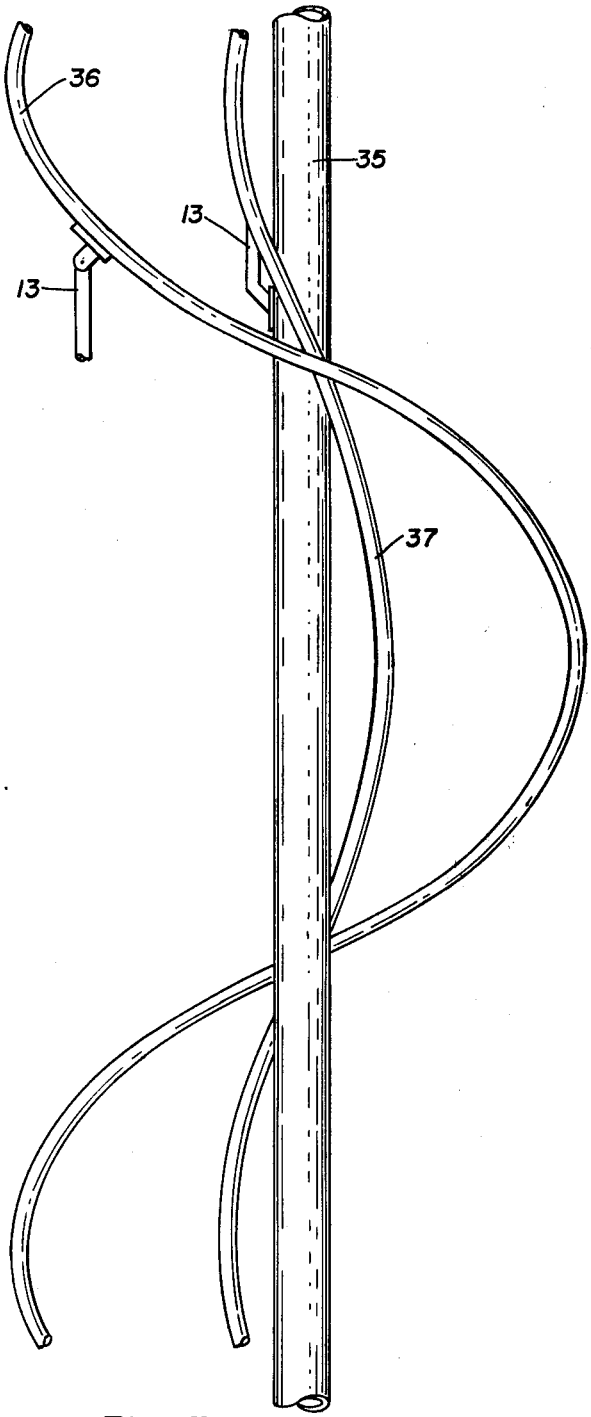
FIG. 3 is a partial elevation view of the central support column, the handrails, and two baluster means for a spiral staircase illustrating an embodiment of this invention.

The assembly of this invention employs a flexible handrail element generally designated 10 which includes a central, stranded, aluminum cable core 11 and a tightly adhering plastic coating 12. The handrail 10 is at least 0.75 inches in diameter, and preferably it is between 1 and 1.5 inches in diameter. The size of the handrail is selected to provide a secure and comfortable handgrip for one using a staircase, and it may be varied to meet the particular needs and aesthetic requirements for any given staircase. A very suitable material for use as a handrail is insulated, aluminum, electrical cable. Insulation for such cable normally is polyvinylchloride (PVC) which is a tough, durable, thermoplastic material that may be made in various colors and that is capable of being welded and polished to have a smooth and shiny appearance. In all of the figures illustrating this invention, the cross section of stranded aluminum cable is shown with widely spaced section lines in that a true representation of the cross section of a spirally-wound cable would serve more to obscure the illustrations than to clarify them.

A baluster, generally designated 13, includes an upright portion partially shown at 15 and a support means 16 that is connected to the handrail 10. The support means 16 includes a tongue element 17 and flange-like element 18 and it is pivotally connected through pin 20 to the upright portion 15 so that the flange 18 can assume any angle that the handrail 10 may take to form a firm connection to it. A portion of the plastic coating 12 is removed so that the flange 18 is recessed into the handrail and therefore less apparent. It is not essential to the invention that the flange 18 be recessed.

Flange 18 is connected to the stranded cable 11 with screws 21 and 22. Screws 21 and 22 are in a preferred position, both being located upwardly with regard to tongue 16 to provide easy access for a screw driver. It has been found that stranded aluminum cable is so tightly wound and the cracks between adjacent strands at the surface are so completely filled with plastic coating, that the stranded cable is essentially the same as a solid metal element with regard to receiving threaded fasteners such as screws 21 and 22. Thus, a guide hole can be drilled radially into the stranded cable even though the point of the drill first encounters a cable strand on a chord of its cross section, and threaded fasteners embedded in the stranded cable form a very firm connection.

FIG. 1 also illustrates an embodiment of this invention wherein a metal or plastic element is employed as an end cap to provide a finished termination to the handrail. The end cap generally illustrated at 23 includes a cup 25 having an inside diameter which closely embraces the outside diameter of the stranded cable 11. To connect the metal end cap, the end portion of the plastic coating 12 is stripped from the cable, and the stranded cable protruding from the stripped end portion is inserted into the end cap 23 far enough so that the open end of the end cap 23 abuts the plastic coating 12 at location 26. It is desirable to have the end cap fairly deep so that a significant portion of the end of the stranded cable is inserted into it whereby the end cap 23 can be fixed on the end of the handrail firmly and without wobbling. The end cap may be fixed to the end of the handrail with adhesive, but it is preferred to employ a screw as at 27 to hold the end cap firmly in place. The screws 21, 22 and 27 are preferably countersunk and occupy a position on the bottom of the handrail so that they are neither visible nor can they be felt in the use of the assembly of this invention.

FIG. 2 illustrates an embodiment of this invention where the handrail assembly is employed with a staircase having a landing. The portion of the staircase having treads and risers is illustrated generally at 30, and the landing is illustrated generally at 31. The stairs 32 have connected to the balusters 13 which in turn support the handrail 10. On the landing 31, the handrail 10 is horizontal and slight variations in its elevation between balusters would be visible. It is a preferred embodiment of this invention that on all portions of the assembly that are horizontal a continuous rigid support element 33 be employed in place of individual flanges such as flange 18. The balusters 13 on the landing may be the same as the balusters 13 on the staircase in that the pivoted connection between the upright portion 15 and the tongue 17 accommodates as well to a horizontal flange as it does to one at an angle.

The value of the present invention can be best illustrated with a spiral staircase which is the most extreme problem of providing a suitable handrail on a curved staircase. FIG. 3 illustrates only the supporting column, the inside and outside handrails of a spiral staircase, and two baluster means. The treads and risers are conventional elements that are not illustrated in FIG. 3. Spiral staircases normally are made of a group of pie-shaped treads that a connected to the central supporting column 35 either with a central cylindrical element that slides over the column 35 or by being fixed with bolts, rivets or welding to the central column 35. It is relatively easy to assemble a series of stair treads around the central column 35 to produce a regularly rising spiral staircase. However, the outside handrail 36 must be substantially longer than the inside handrail 37 which traverses the same number of turns as the outside handrail but does so on a much smaller radius. Desirably, at each level of elevation, the inside handrail and the outside handrail are at the same elevation, and as a result the inside handrail in addition to being much shorter than the outside handrail rises at a much greater pitch. That is, the increase in elevation per unit of length of the inside handrail is much greater than the increase in elevation per unit of length of the outside handrail. It is evident from FIG. 3 that pre-forming, shipping, and assembling the handrails 36 and 37 would be a difficult and expensive job. Since each tread is a small, flat unit having the same shape as all other stair treads, forming, shipping and assembling the stair treads is a relatively easy and inexpensive job. In addition, it is very difficult to assemble a continuous, one-piece handrail for both handrail 36 and 37 if the spiral staircase rises a distance that requires more than one complete cycle around it. In forming handrails 36 and 37, whether they are formed of many short segments or one long one, it is necessary not only to bend them to rise at the correct pitch but it is also necessary to twist them on their longitudinal axis. This situation is analogous to coiling a hose where for each complete coil it is necessary to twist the hose one revolution on its longitudinal axis in order for the coil to be without kinks.

The present invention readily solves the problems of providing handrails for spiral staircases. A series of balusters, such as baluster 13, can be connected to the tread of a spiral staircase so that at each stair tread an upper support at the proper height for the handrail 36 is provided. By employing the flexible, plastic-covered stranded aluminum cable as the handrail, simply placing the cable in its appropriate position to be fastened to each baluster 13 provides a handrail having a perfect alignment and perfect pitch. In addition, the handrail can be twisted appropriately as it is installed so that a helical twist on its longitudinal axis is easily and automatically provided during installation. Interior handrail 37 may be installed as readily. Baluster 13 is connected directly to column 35 instead of to the stair tread but each baluster 13 holding the interior handrail 37 is positioned so that its upper portion holds the handrail at the same elevation as outer handrail 36 which is on the same radius of the column 35. When all of the balusters 13 connected to column 35 have been placed in the proper position, the flexible, plastic-coated stranded aluminum cable 37 may be readily attached to each of the balusters connected to column 35, and the handrail when fixed to those balusters will automatically be at the proper position and have the proper longitudinal helical shape.

Handrails of plastic-coated, stranded aluminum cable at least 0.75 inches in diameter are flexible enough to be stretched around curves and into the form of helixes but they are rigid enough to form a very stiff link between adjacent balusters. Most staircases have balusters spaced a maximum of 9 inches apart both for the sake of appearance and to comply with safety codes. A plastic-coated stranded aluminum cable segment 9 inches long is almost inflexible, and the 9-inch link becomes even more rigid when secured at both ends to adjacent balusters.

Figure 4:
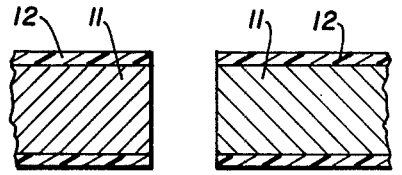
FIGS. 4, 5, 6, 7 and 8 are partial sectional views illustrating a sequence of steps embodying this invention that may be employed to splice the handrail assembly of this invention.
Figure 5:
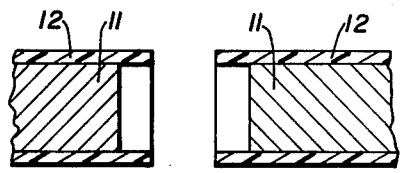
Figure 6:
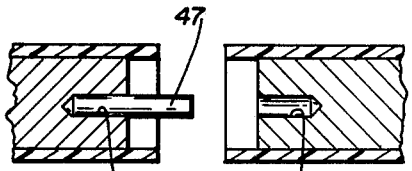

Although the assembly of the present invention permits continuous, one-piece handrails to be employed on staircases of almost any shape or length, it may sometimes be desirable to splice a handrail of this invention. It may also be desirable to provide means for the handrail assembly of this invention to turn a sharp corner. FIGS. 4 through 8 illustrate an embodiment of the present invention wherein the handrail is spliced. FIGS. 4 through 8 represent sequential steps employed in the splicing process. The first step illustrated in FIG. 4 is to provide square cuts on the ends of the handrail to be spliced. WHen the ends have been cut square, the stranded aluminum cable is recessed at least ⅛ of an inch and preferably no more than ¼ inch leaving a protruding portion of the plastic coating 12 extending beyond the ends of the metal cable. Recessing can be readily accomplished with available tools such as an end mill. The splicing can be most advantageously made if the two segments to be spliced are fixed together with a pin. A pin is not essential to forming a splice but it is preferred because it makes the two ends rigidly aligned with one another. FIG. 6 illustrates a pin 47 set in a hole 46 drilled into the end of the stranded cable. The other end of the stranded cable has a corresponding hole 46 drilled into it to accept the pin in the same alignment.

Figure 7:
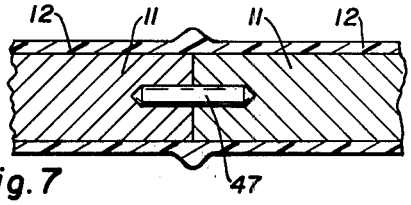
Figure 8:
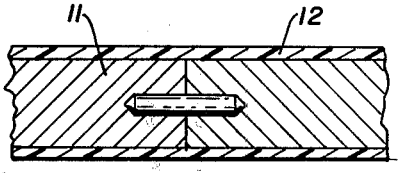

When splicing is to be accomplished, the two protruding ends of coating 12 are heated to a temperature at which they can be welded by being forced together or otherwise put in a condition to be welded, for example by using a solvent for the plastic. When they are at that temperature or otherwise in condition to be welded, the ends of stranded cable 11 are forced into contact with each other, and pin 47 occupies both holes 46 as illustrated in FIG. 7. In forcing the two ends of stranded cable 11 together, an upset weld 39 is produced. Particularly with PVC and with many other thermoplastic materials, an upset weld such as the one formed at 39 is a true weld where the protruding edges of the two segments of plastic coating become a single piece of material at weld 39. The upset weld 39 is permitted to cool or otherwise set, after which it is trimmed and polished to produce a splice as illustrated at FIG. 8. The PVC weld, and indeed the entire handrail, can be put in a very smooth, shiny and decorative form by cleaning first with methylenechloride and then polishing by buffing the surface with tetrahydrofuran. The upset weld is first cut away with a tool after which the cleaning and buffing solutions soften and polish the PVC so that irregularities in the surface at the weld substantially disappear.

Figure 9:
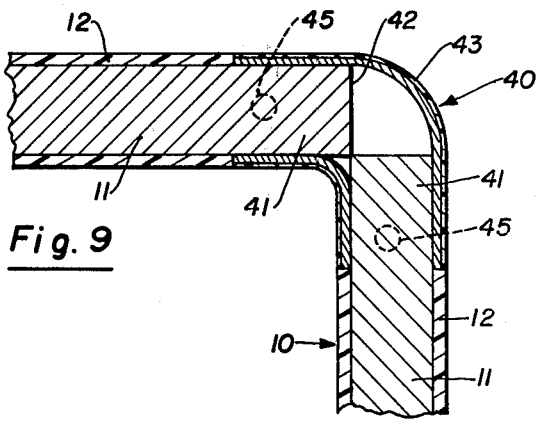
FIG. 9 is a sectional plan view illustrating a fitting embodying this invention that is employed to provide a sharp corner in the handrail assembly of this invention.

FIG. 9 illustrates an embodiment of the invention where the handrail assembly may be adapted to turn a sharp corner. One of the benefits of the plastic-coated stranded aluminum handrail employed in this invention is that it is stiff in short lengths while it is flexible in long lengths. This advantage creates a difficulty when it is necessary to provide a sharp bend in the handrail, for example a 90° turn on a landing. For such situations, it is an embodiment of this invention to use a rigid fitting such as an elbow which is particularly adapted to produce the effect of a continuous handrail when employed with a plastic-coated, stranded cable. As illustrated in FIG. 9, the rigid fitting 40 is made of metal or other rigid material and has an elbow-like shape. The ends of the handrail 10 are stripped of their plastic coating 12 so that a portion of the stranded aluminum cable 11 protrudes beyond the plastic. This portion is illustrated as 41 in FIG. 9. The two segments of handrail that are to be joined at the sharp bend are first prepared by removing enough plastic coating to insert an adequate length of stranded cable into the sharp bend fitting 40. The outside diameter of fitting 40 is the same as the outside diameter of the handrail 10 so that a smooth, continuous-appearing assembly is made. The fitting 40 includes an interior metal portion 42 and preferably a coating 43. The coating 43 preferably is of the same material as the plastic 12, but is may be painted the same color or it may be a contrasting color or texture, and it is within the scope of the invention to have no coating at all for fitting 40 and to leave it as a shiny or brushed metal surface. Screws 45 or adhesive may be employed to maintain end 41 of the stranded cable fixed within the fitting 40. As illustrated, the inside diameter of the fitting 40 is such as to closely embrace the outside diameter of the end 41 of the stranded cable 11. However, it is within the scope of this invention to have the inside diameter of fitting 40 fit closely over a relieved but not completely removed portion of the plastic coating 12.

Figure 10:
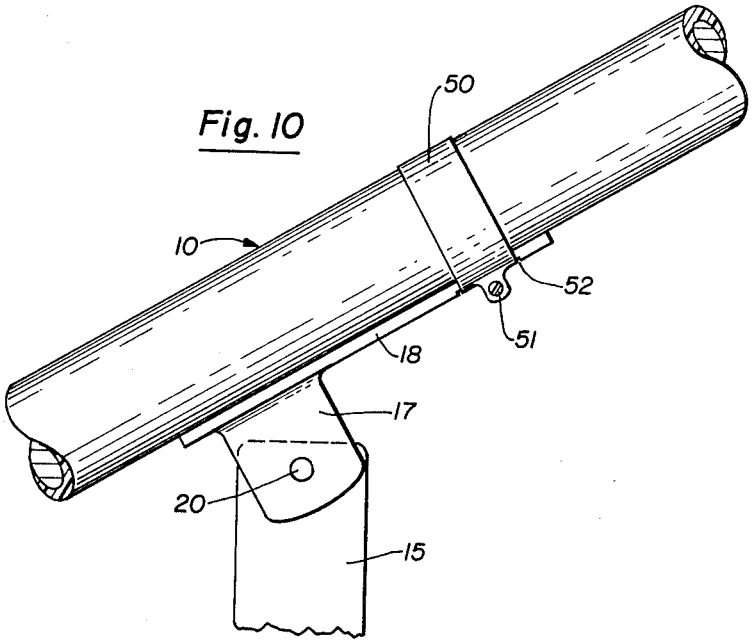
FIG. 10 is a partial elevation view of a handrail embodying this invention.

Another embodiment of this invention is illustrated in FIG. 10. The embodiment of FIG. 10 is particularly useful for temporary handrails such as for use on construction sites and for industrial use where fine finishing is not important. In the embodiment of FIG. 10 the stranded, plastic-coated, aluminum cable 10 is connected to the flange 18 by an encircling metal member 50 which may be formed as a hose clamp. The metal member 50 encircles both the cable 10 and the flange 18 and may rest in a groove 52 formed in flange 18 to accommodate member 50. Member 50 may be made as a thin, narrow strap which, when tightened around cable 10, will depress the plastic coating and become somewhat embedded in it, thereby providing a smooth handrail even where the metal band encircles it.

Although connector 50 is shown as being tightened with a nut and bolt arrangement similar to a hose clamp, many other arrangements employing springs, clips, or other tightening fasteners known to the art may be used. The fastening means should be selected to avoid sharp or otherwise hostile elements, and the fastening means may be at least partly covered with protective materials to avoid discomfort when using the handrail. Positioning the connector at or near the tongue 17 will provide a shielding effect that will largely avoid contact between the tightening means 51 and the hands of a user of the handrail.

Figure 11:
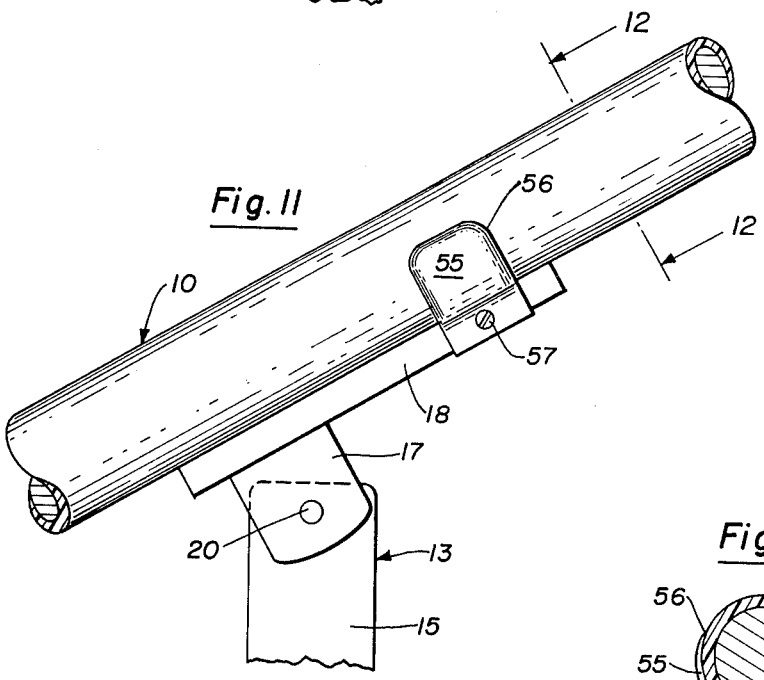
FIG. 11 is a partial elevation view of a handrail embodying this invention.
Figure 12:
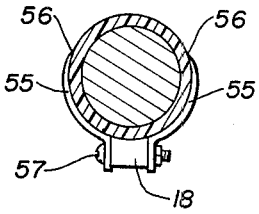
FIG. 12 is a sectional view of FIG. 11 taken along the lines 12—12.

Another suitable connector is illustrated in FIGS. 11 and 12. This connector is formed from a pair of C-shaped clamps 55 that embrace handrail 10 and encircle it more than half way around its circumference. Clamps 55 are held tightly in place by bolt 57 which can be tightened enough to cause the clamps 55 to become slightly embedded in the plastic coating of handrail 10. A preferred embodiment as illustrated in FIGS. 11 and 12 shows clamps 55 having a feathered edge 56 which will produce a smooth intersection between handrail 10 and clamp 55 that will avoid all possibilities of discomfort.

Flange 18 may be provided with a hole drilled horizontally through it to accommodate it to the embodiment illustrated in FIGS. 11 and 12.

What is claimed is:

1. A handrail assembly for a curved staircase comprising a plurality of baluster means having support means to support a cylindrical handrail and means to accept a connector, and having means to fix said baluster means at a predetermined height above said staircase, a stranded cylindrical aluminum cable coated with flexible plastic material, said coated cable having an outside diameter at least 0.75 inches, and said cable being fastened to each of said support means with a connector.

2. The handrail assembly of claim 1 wherein said connector is a screw penetrating said stranded cable.

3. The handrail assembly of claim 1 wherein said connector is a tight metal band encircling said cable and said support means.

4. The handrail assembly of claim 1 wherein said connector comprises two clamp-like elements partly encircling said stranded cable and connected to said support means.

5. The handrail assembly of claim 1 wherein said plastic material is thermoplastic.

6. The handrail assembly of claim 1 wherein said plastic material is polyvinylchloride.

7. The handrail assembly of claim 1 wherein said support means is pivoted to the top of said baluster means.

8. The handrail assembly of claim 1 wherein said support means is relieved into said plastic material.

9. The handrail assembly of claim 1 wherein the support means between consecutive baluster means at the same elevation comprises a continuous support means.

10. The handrail assembly of claim 1 including a sharp bend comprising a metal fitting, said metal fitting having the same outside diameter as said plastic-coated, stranded aluminum cable, and having said cable inserted into and fixed to said fitting.

11. The assembly of claim 10 wherein said metal fitting is coated with plastic material.

12. The handrail assembly of claim 1 including a metal end cap, said end cap having the same outside diameter as said plastic-coated, stranded aluminum cable, and having said cable inserted into and fixed to said end cap.

13. The assembly of claim 12 wherein said end cap is coated with plastic material.

* * * * *

UNITED STATES PATENT AND TRADEMARK OFFICE

CERTIFICATE OF CORRECTION

PATENT NO. : 4,193,585
DATED : March 18, 1980
INVENTOR(S) : Roger Eandi

It is certified that error appears in the above-identified patent and that said Letters Patent are hereby corrected as shown below:

COL. 3, line 54, after "to" delete "the" and insert

---them---;

COL. 4, line 6, after "that" delete "a" and insert

---are---; and

COL. 6, line 16, after "but" delete "is" and insert ---it---.

Signed and Sealed this

*Third* Day of *February 1981*

[SEAL]

*Attest:*

RENE D. TEGTMEYER

*Attesting Officer* *Acting Commissioner of Patents and Trademarks*